US010245493B2

(12) United States Patent
Beedle et al.

(10) Patent No.: US 10,245,493 B2
(45) Date of Patent: Apr. 2, 2019

(54) TEE

(71) Applicants: Robert A. Beedle, Bayport, MN (US); Timothy J. Kelley, Stillwater, MN (US)

(72) Inventors: Robert A. Beedle, Bayport, MN (US); Timothy J. Kelley, Stillwater, MN (US)

( * ) Notice: Subject to any disclaimer, the term of this patent is extended or adjusted under 35 U.S.C. 154(b) by 0 days.

(21) Appl. No.: 15/255,612

(22) Filed: Sep. 2, 2016

(65) Prior Publication Data

US 2017/0065865 A1 Mar. 9, 2017

Related U.S. Application Data

(60) Provisional application No. 62/214,391, filed on Sep. 4, 2015.

(51) Int. Cl.
*A63B 69/00* (2006.01)
*A63B 1/00* (2006.01)
*A63B 69/40* (2006.01)

(52) U.S. Cl.
CPC ..... *A63B 69/0075* (2013.01); *A63B 69/0002* (2013.01); *A63B 2069/0008* (2013.01)

(58) Field of Classification Search
CPC ..... A63B 69/0075; A63B 69/0002; A63B 2069/0008
USPC ..... 473/451, 422–430, 453, 417, 454, 419; 434/247; 482/148, 109, 118, 122
See application file for complete search history.

(56) References Cited

U.S. PATENT DOCUMENTS 5,156,402 A * 10/1992 Hart ..... A63B 21/00061 473/229
5,478,070 A * 12/1995 Morrison ..... A63B 69/0075 473/419
5,672,118 A * 9/1997 Robbie ..... A63B 69/3623 473/257
6,435,990 B1 * 8/2002 Bradley ..... A63B 69/0002 473/415
6,461,255 B1 * 10/2002 Smith ..... A63B 69/0002 473/417
7,517,290 B1 * 4/2009 Springer ..... A63B 69/0002 473/422
9,061,190 B2 * 6/2015 Willardson ..... A63B 69/0002 473/417

(Continued)

OTHER PUBLICATIONS

"Back Spin Tee: Turning Baseball Upside Down", http://www.backspintee.com/, retrieved from the internet on Dec. 19, 2016 (7 pages).

(Continued)

*Primary Examiner* — Mitra Aryanpour
(74) *Attorney, Agent, or Firm* — Dicke, Billig & Czaja, PLLC

(57) ABSTRACT

A tee for supporting a ball. The tee comprising a base, a vertical support extending from the base and a ball support assembly adjustably secured to the vertical support. The ball support assembly is arranged and configured to support a ball and is slidably, pivotably and/or rotatably adjustable within one or more planes defined by the base, vertical support and ball support assembly to adjust the position of the ball support assembly, and thus a ball, in a variety of positions. The tee can also be vertically adjustable along the vertical support.

23 Claims, 10 Drawing Sheets

(56) References Cited

U.S. PATENT DOCUMENTS

| | | | | |
|---|---|---|---|---|
| 2003/0220177 | A1* | 11/2003 | Orlando | A63B 21/04 482/148 |
| 2006/0089212 | A1* | 4/2006 | Marchel | A63B 21/026 473/422 |
| 2006/0148597 | A1* | 7/2006 | Pope | A63B 69/0002 473/453 |
| 2006/0240917 | A1* | 10/2006 | Campbell | A63B 69/0002 473/453 |
| 2007/0129182 | A1* | 6/2007 | Taylor | A63B 69/0057 473/422 |
| 2008/0248900 | A1* | 10/2008 | Hernandez | A63B 69/0002 473/453 |
| 2011/0077109 | A1* | 3/2011 | Crowley | A63B 69/0002 473/453 |
| 2017/0065865 | A1* | 3/2017 | Beedle | A63B 69/0075 473/417 |

OTHER PUBLICATIONS

"Champro the Ultimate 3-in-1 Batting Tee B069", http://baseball.epicsports.com/prod/45104/index.html, retrieved from the internet on Dec. 19, 2016 (3 pages).

"CHAMPRO Sports®—The Ultimate Batting Tee", http://shop.champrosports.com/p-11480the-ultimate-batting-tee.aspx, 1 page, known of prior to Sep. 4, 2015.

"Advanced Skills Tee", http://www.muhltech.com/Advanced_Skills_Batting_Tee_p/ast.htm, 2 pages, known of prior to Sep. 4, 2015.

"PBI Pro Baseball Insider, Top 5 Batting Tees", http://probaseballinsider.com/best-batting-tee/—Aug. 6, 2015, 6 pgs.

"Louisville Slugger Ultra Instructoswing Batting Tee", http://www.sportsauthority.com/product/index.jsp?productId=33066526&srccode=cii_328 . . . —Aug. 24, 2015, 2 pgs.

* cited by examiner

TEE

RELATED APPLICATIONS

This application claims the benefit of U.S. Provisional Application No. 62/214,391 filed on Sep. 4, 2015 titled "Batting Tee", the disclosure of which is hereby incorporated by reference in its entirety.

BACKGROUND

Disclosed embodiments relate to tees that can be used to support a ball for batting practice or the like.

A batting tee or "T" is used as a replacement for a pitcher in baseball, softball and similar sports and is generally configured to support a ball at a suitable height for a batter to hit. Typical batting tees include a vertical structure or stand on top of which a ball can be placed and maintained in position for hitting with a bat.

The disclosed embodiments address problems and limitations associated with the related art.

SUMMARY

The above-mentioned problems associated with prior devices are addressed by embodiments of the present invention and will be understood by reading and understanding the present specification. The following summary is made by way of example and not by way of limitation. It is merely provided to aid the reader in understanding some of the aspects of the invention.

Disclosed embodiments include a tee for supporting a ball. The tee could be used for batting/hitting practice or the like and, for example, is capable of simulating a variety of pitches in baseball and softball applications.

Generally, in one example embodiment, the tee includes a base, a vertical support extending from the base and a ball support assembly adjustably secured to the vertical support. The ball support assembly is arranged and configured to support a ball and is slidably, pivotably and/or rotatably adjustable about one or more axes and planes defined by the base, vertical support and ball support assembly to adjust the position of the ball support assembly, and thus a ball, in a variety of positions.

In one example embodiment, a tee for supporting a ball comprises a base, a vertical support, and a ball support assembly. The base defines an x-axis. The vertical support extends from the base and defines a z-axis. The ball support assembly is adjustably secured to the vertical support and defines a y-axis. The x-axis and the y-axis define a xy-plane, the x-axis and the z-axis define a xz-plane, and the y-axis and the z-axis define a yz-plane. The ball support assembly is arranged and configured to support a ball and is adjustable along the z-axis and within at least one plane selected from the group consisting of the xy-plane, the xz-plane and the yz-plane.

In one example embodiment, the ball support assembly includes two extension arms interconnected by a connecting arm to form a generally "C" shaped configuration. Extending from each of the extension arms is a respective suspension member, wherein a ball can be positioned and maintained between the suspension members, regardless of the position of the ball support assembly. Suspension members can include, for example, brushes, plungers or the like. In certain embodiments, the suspension members are biased so that if a bat or other object swinging at the ball contacts one or more suspension members, the suspension members give way and then return to their original position.

Additional objects, advantages, and features will become apparent from the following description and the claims that follow, considered in conjunction with the accompanying drawings.

BRIEF DESCRIPTION OF THE DRAWINGS

The present invention can be more easily understood, and further advantages and uses thereof can be more readily apparent, when considered in view of the detailed description and the following Figures in which.

In accordance with common practice, the various described features are not drawn to scale but are drawn to emphasize specific features relevant to the present invention. Reference characters denote like elements throughout the Figures and the text.

DETAILED DESCRIPTION

In the following detailed description, reference is made to the accompanying drawings, which form a part hereof, and in which is shown by way of illustration embodiments in which the inventions may be practiced. These embodiments are described in sufficient detail to enable those skilled in the art to practice the invention, and it is to be understood that other embodiments may be utilized and mechanical changes may be made without departing from the spirit and scope of the present invention. The following detailed description is, therefore, not to be taken in a limiting sense, and the scope of the present invention is defined only by the claims and equivalents thereof.

Figure 21:
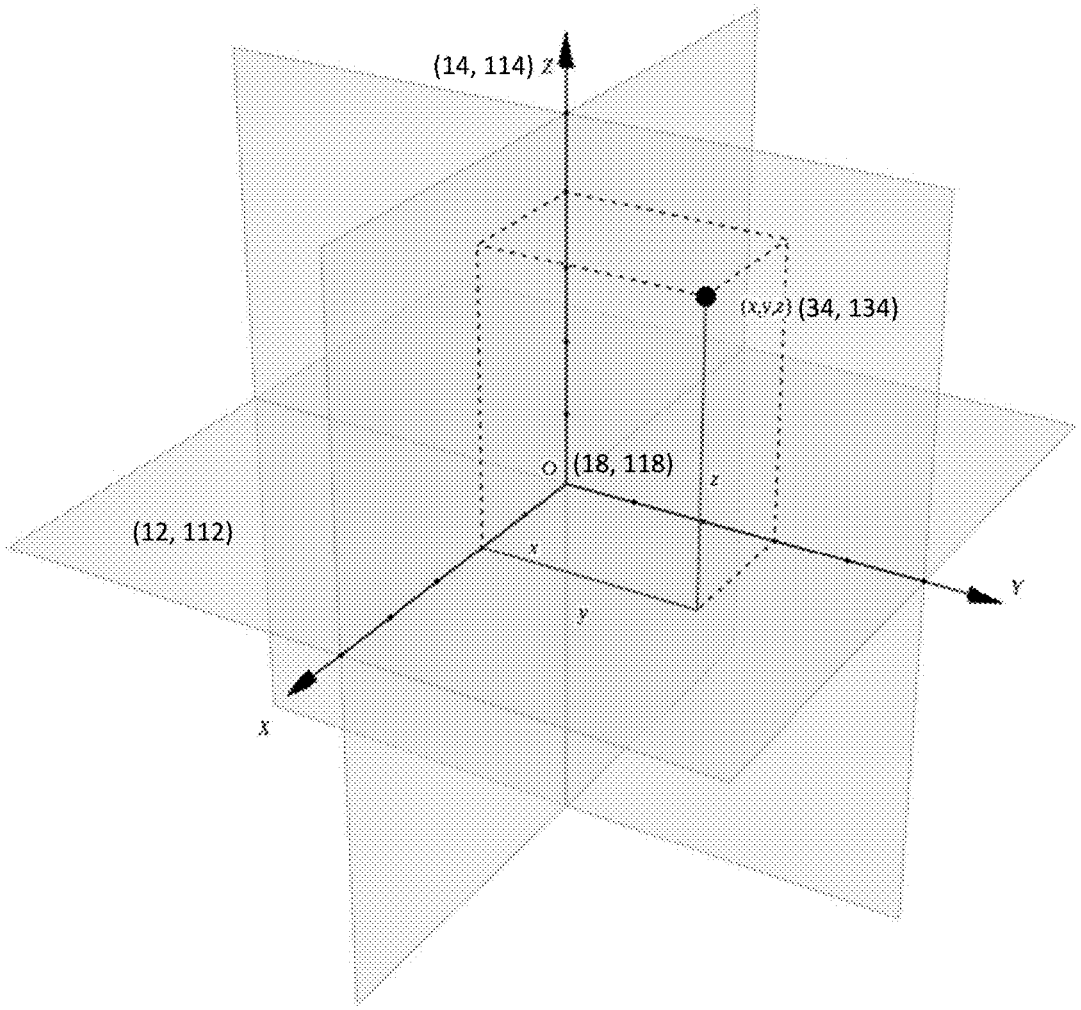
FIG. 21 is a Cartesian coordinate system diagram for reference when describing the embodiments disclosed herein.

The following disclosure references various axes and planes defined by said axes to define rotational and relative movement of various components with respect to one another. In reading the disclosure below, the reader's attention is directed to FIG. 21, which provides a visual aide for visualizing the respective axes and planes discussed herein.

One example embodiment of a tee 10 is generally depicted in FIGS. 1-7. In this embodiment, the tee 10 includes a base 12 to which a vertical support 14 is connected. The base 12 provides stability on the ground or other support surface. Although the base 12 is shown in a generally cross-shaped configuration, any suitable base or configuration could be used (e.g., H-shaped or rectangular). The vertical support 14 can be a unitary piece, comprise multiple components 16*a*, 16*b* and/or can be telescoping to allow for adjustability in height. Attached to the vertical support 14 is a ball support assembly 34, which is configured to slidably, pivotably and/or rotatably adjustable to position and support a ball 1, in a variety of positions as will be discussed in further detail below.

Figure 5:
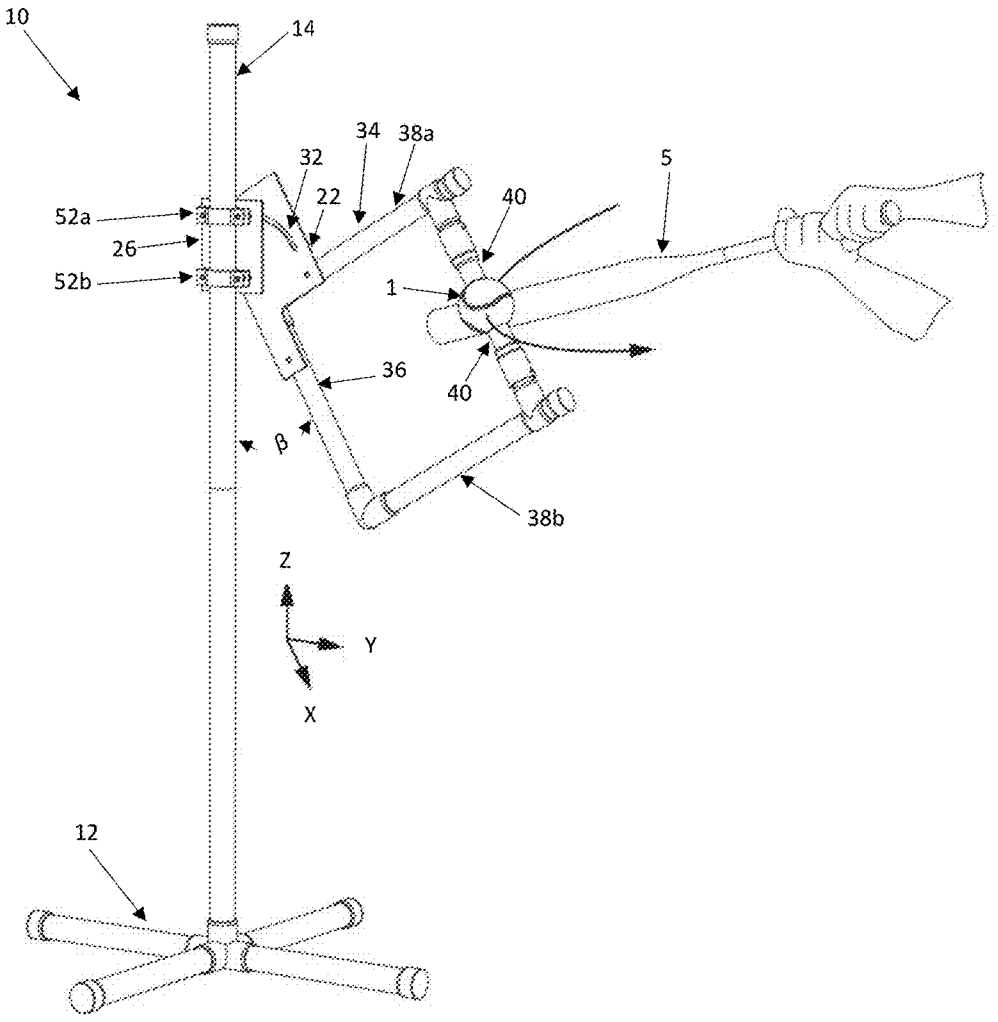
FIG. 5 is a partial, perspective view of a batter swinging at a ball supported by the tee of FIGS. 1-2.
Figure 11:
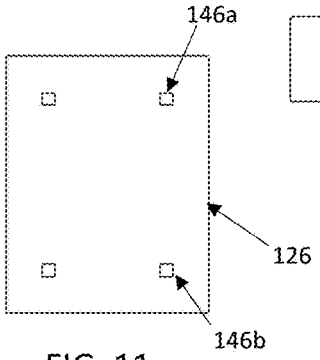
FIG. 11 is a front view of a connecting plate for embodiments disclosed herein.
Figure 12:
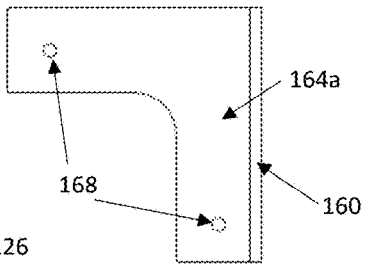
FIG. 12 is a front view of a ball path adjuster bracket of the tee of FIGS. 8-10.
Figure 13:
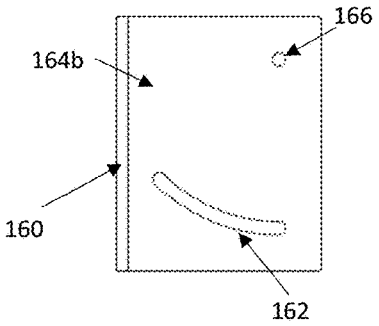
FIG. 13 is a side view of the ball path adjuster bracket of FIG. 12.
Figure 14:
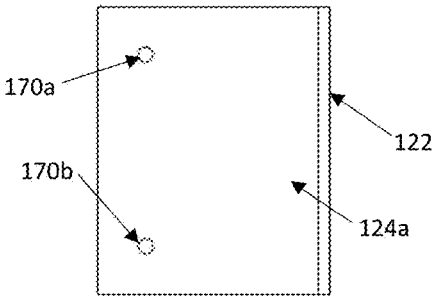
FIG. 14 is a side view of a bat path adjuster bracket of the tee of FIGS. 8-10.
Figure 15:
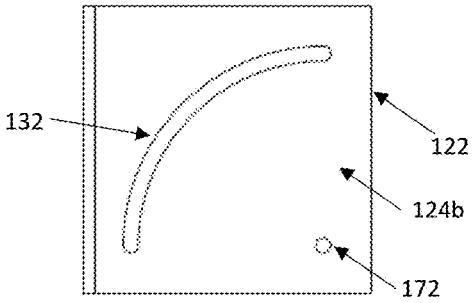
FIG. 15 is a front view of the bat path adjuster bracket of FIG. 14.
Figure 16:
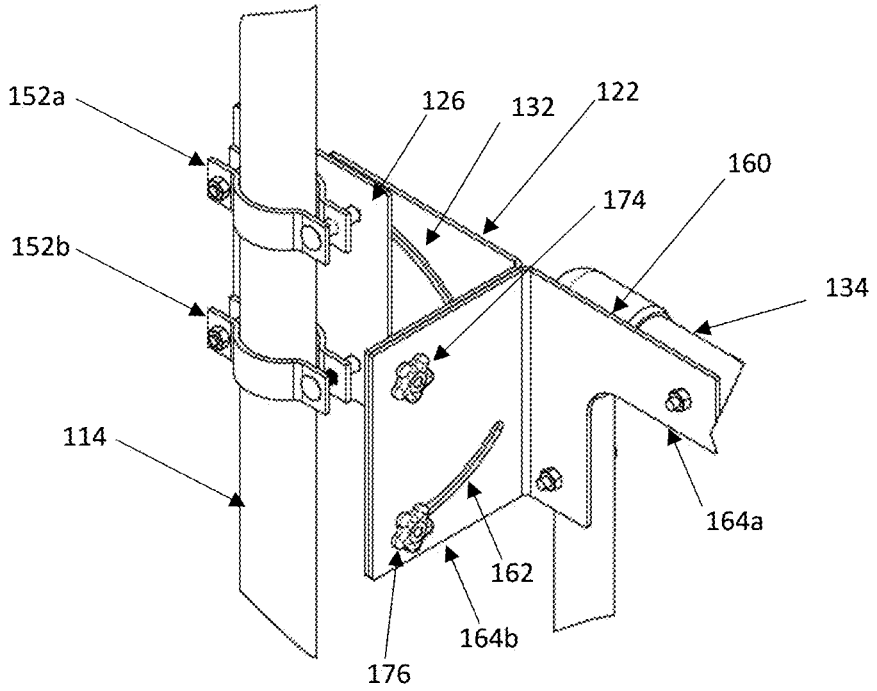
FIG. 16 is a partial, perspective rear view of the tee of FIGS. 8-9.
Figure 17:
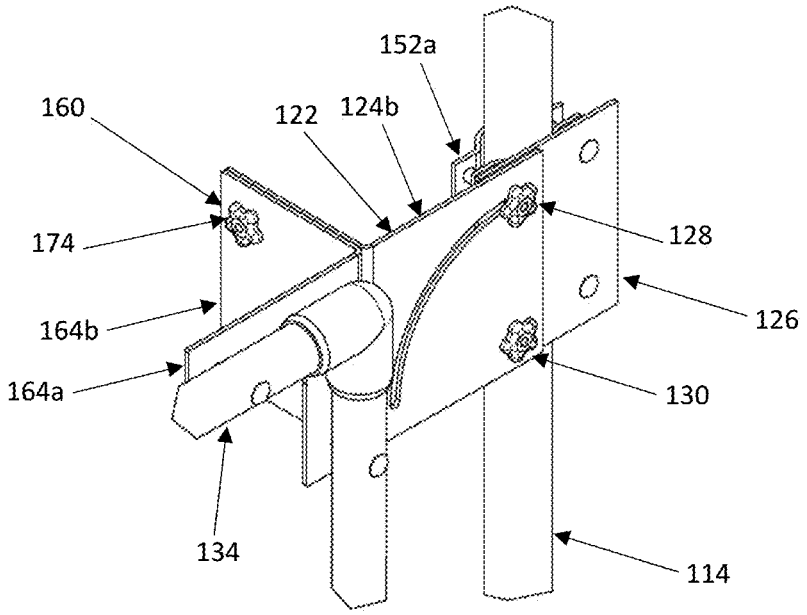
FIG. 17 is a partial, perspective front view of the tee of FIGS. 8-9.
Figure 20:
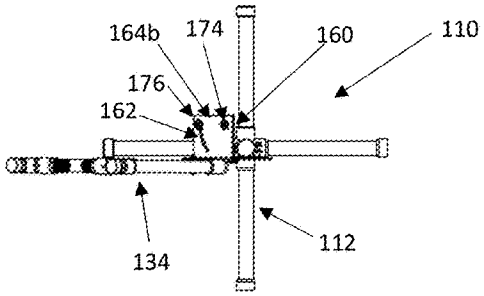
FIG. 20 is a top view of the tee of FIGS. 8-10 in the position of FIGS. 16-17.
Figure 19:
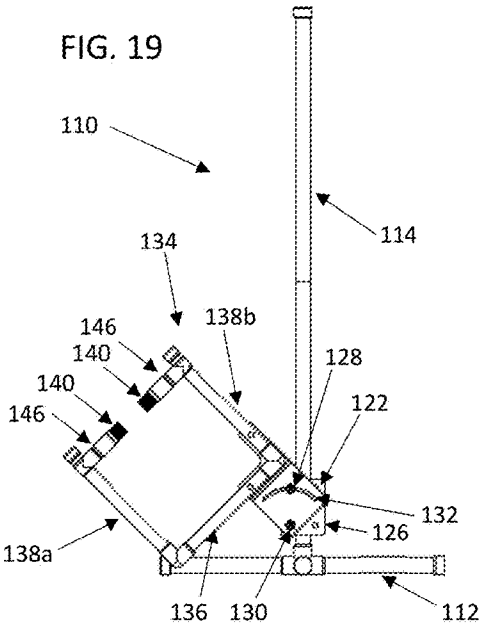
FIG. 19 is a front view of the tee of FIGS. 8-10 in the position of FIG. 18.
Figure 18:
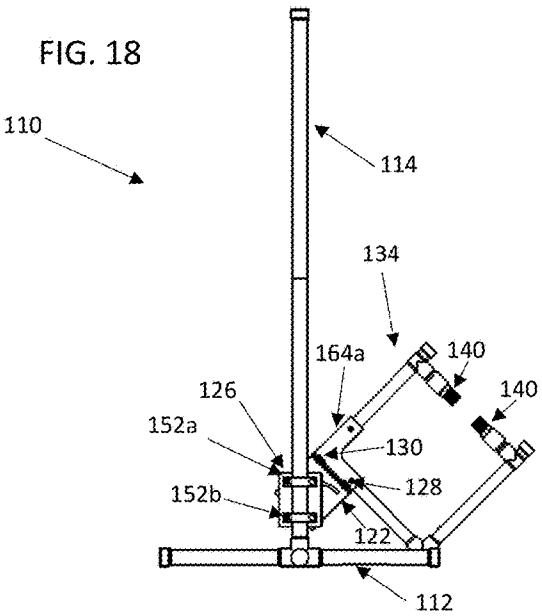
FIG. 18 is a rear view of the tee of FIGS. 8-10 arranged in a position different from that of FIGS. 8-10.

To provide for adjustment of the ball support assembly 34 within the xz-plane as defined in FIG. 5, a bat path adjuster bracket 22 is operatively connected to the vertical support 14. The bat path adjuster bracket 22 is operatively connected with a connector plate 26 that is operatively connected with an angle adjustment assembly 28 and a vertical adjuster 30. The bat path adjuster bracket 22 and the connector plate 26 include respective apertures (see also FIGS. 11 and 14-15 as discussed below with respect to additional embodiments) through which the vertical adjuster 30 extends to contact the vertical support 14. The bat path adjuster bracket 22 includes an arched or angled slot 32 and the connector plate 26 includes an aperture (see also FIGS. 11 and 14-15 as discussed below with respect to additional embodiments) through which the angle adjustment assembly 28 extends. The ball support assembly 34 is operatively connected to the bat path adjuster bracket 22 with mechanical fasteners or the like. In one example embodiment, the ball support assembly 34 includes a connecting arm 36 to which the bat path adjuster bracket 22 is connected and has two extension arms 38*a*, 38*b* that extend outwardly from the connecting arm 36 at approximately 90 degrees. In the illustrated example embodiment, to adjust the bat path adjuster bracket 22 within the yz-plane, the angle adjustment assembly 28 is rotated (e.g., counterclockwise via a knob) to release maintaining friction on the bat path adjuster bracket 22 so that the bat path adjuster bracket 22 and ball support assembly 34 can rotate with respect to the vertical support 14 within the arched slot 32. Once the desired rotational position is obtained, the angle adjustment assembly 28 is rotated (e.g., clockwise via the knob) in the opposite direction to increase friction between the bat path adjuster bracket 22 and the angle adjustment assembly 28 until there is enough friction to maintain the bat path adjuster bracket 22 in position.

Figure 2:
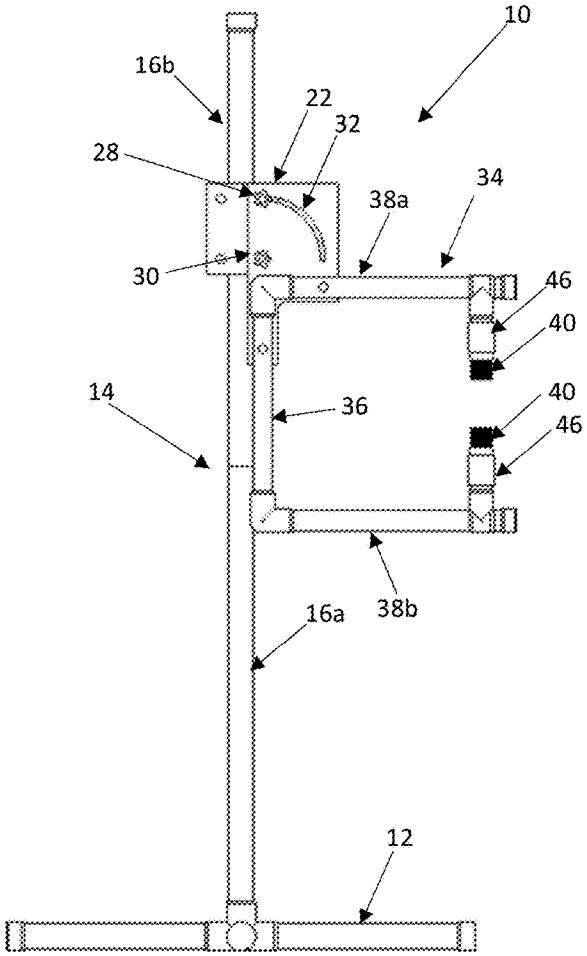
FIG. 2 is a front view of the tee of FIG. 1.
Figure 1:
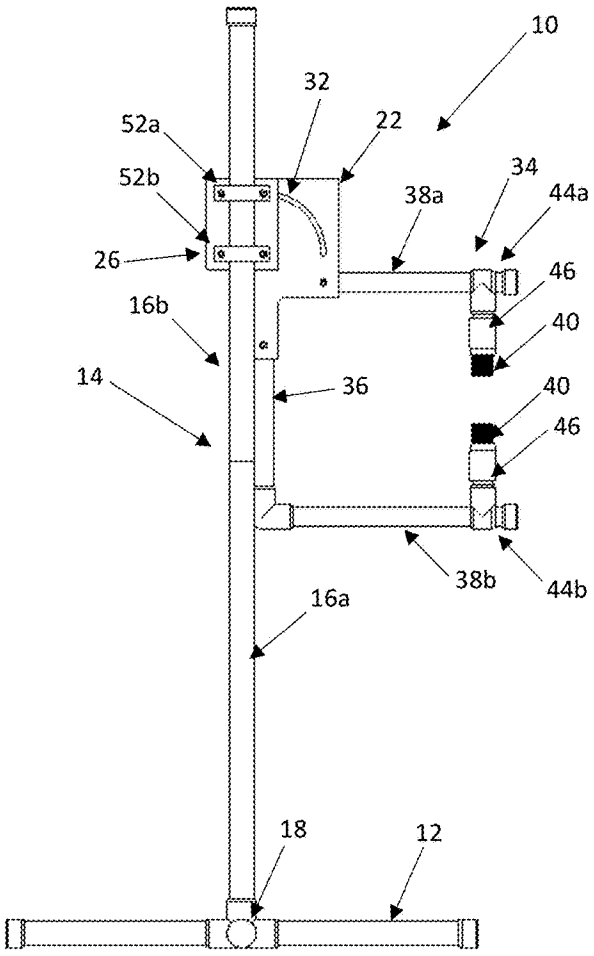
FIG. 1 is a rear view of a tee having a ball support assembly.
Figure 4:
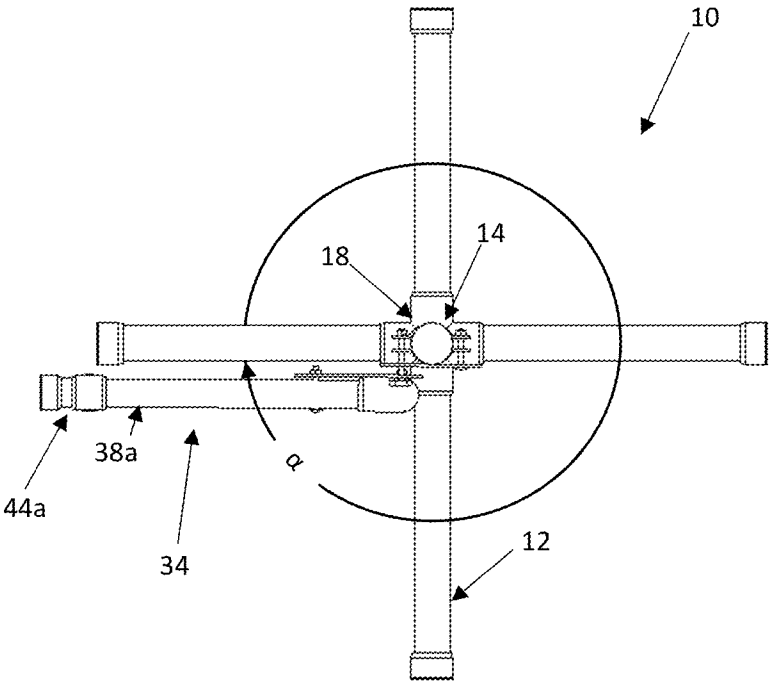
FIG. 4 is a top view of the tee of FIGS. 1-2 illustrating a range of rotation of the ball support assembly about a xy-plane.
Figure 3:
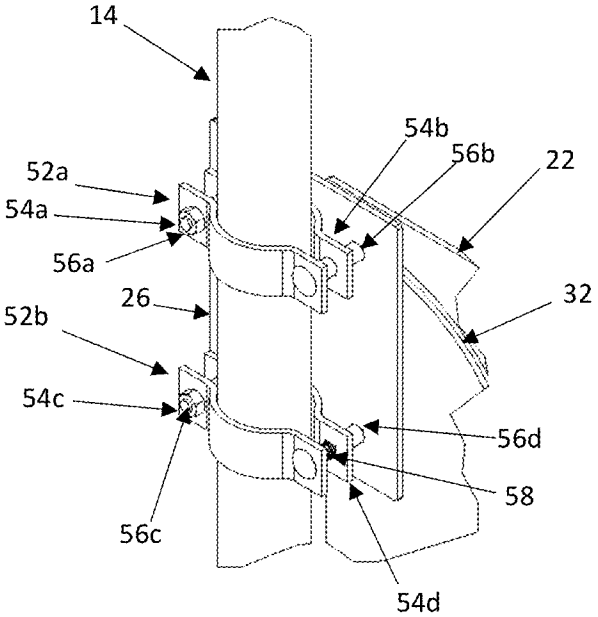
FIG. 3 is a partial, enlarged perspective view of a connection between a vertical support of the tee of FIGS. 1-2 and the ball support assembly.

The vertical adjuster 30 allows the bat path adjuster bracket 22 to be positioned at desired locations along a length (i.e. height) of the vertical support 14 (i.e. the z-axis). In one embodiment, the vertical position of the ball support assembly 34 is adjusted along a length of the vertical support 14 using one or more collars 52*a*, 52*b* that mate with the vertical support 14. As best shown in FIG. 3, one example embodiment includes two collars 52*a*, 52*b* each having a first and second bracket 54*a-d* interconnected with bolts 56*a-d*. Collar 52*a* is positioned on the vertical support 14 to support the bat path adjuster bracket 22 but is not configured to frictionally maintain the ball support assembly 34 in a vertical position (i.e. height, z-axis). Lower collar 52*b* functions to adjust and maintain the vertical position of the ball support assembly 34 on the vertical support 14. The brackets 54*c*, 54*d* are tightened to frictionally engage the vertical support 14 once the ball support assembly 34 has been adjusted to the desired vertical position. The vertical position of the ball support assembly 34 can be re-adjusted by increasing the distance between the brackets 54*c*, 54*d* (e.g., via rotating a knob connected to bolt 56*d* in a counterclockwise rotation) to reduce the friction, adjusting the ball support assembly 34 to the desired vertical position and re-tightening the collar 52*b* around the vertical support 14. In various embodiments, a coil spring 58 is positioned over the bolt 56*d*, between the brackets 54*c*, 54*d* to provide an outward biasing force between the brackets 54*c*, 54*d*. Although not illustrated, there are other suitable methods for adjusting and fixing the ball support assembly 34 in a vertical position. One example includes, but is not limited to, a collar similar to that used on bicycle handle bars and seats that adjusts the vertical position/height of the handle bars and seats. The disclosed embodiments are not intended to be limited to any specific method of providing vertical adjustment of the ball support assembly 34 along the z-axis, as defined by the vertical support 14.

Rotational adjustment of the ball support assembly 34 within the xy-plane about the vertical support 14 (i.e. z-axis) can be accomplished by rotating the loosened collars 52*a*, 52*b* around the vertical support 14 to a desired position before re-tightening the collar 52*b*. In this way, the ball support assembly 34 can be positioned at an angle $\alpha$, ranging from about 0 to about 360 degrees with respect to the base 12 (see, in particular, FIG. 4).

The ball support assembly 34 can include optional mounting members 46 interconnecting the extension arms 38*a*, 38*b* to respective suspension members 40. The mounting members 46, in combination with the suspension members 40, allow a user to hit the ball while the ball support assembly 34 is in a "C" oriented position or "U" oriented position and different positions in-between. The arched slot 32 allows the batter to adjust the angle $\beta$ (see, in particular, FIG. 5) of the ball support assembly 34 from about 0 degrees up to about 90 degrees, as desired. In this way, the ball support assembly 34 enables the batter to hit low inside and low outside simulated pitches as well as high inside and high outside simulated pitches with a "proper" or recommended bat angle. In alternate embodiments (not shown), the arched slot 32 can be designed to allow the user to rotate the ball support assembly 34 at an angle $\beta$ from about 0 degrees ("C" position for a right-handed batter) up to about 360 degrees ("C" position for a left-handed batter) by having the arched slot extend almost 360 degrees within the bat path adjuster bracket 22. The disclosed tee configurations provide significant advantages over typical batting tees that cannot be configured to simulate low inside and low outside or high inside or high outside simulated pitches with "proper" bat angle because, with typical batting tees, the ball rests on the top of a vertical member and the batter would hit the tee obstructing the batter's swing.

Figure 6:
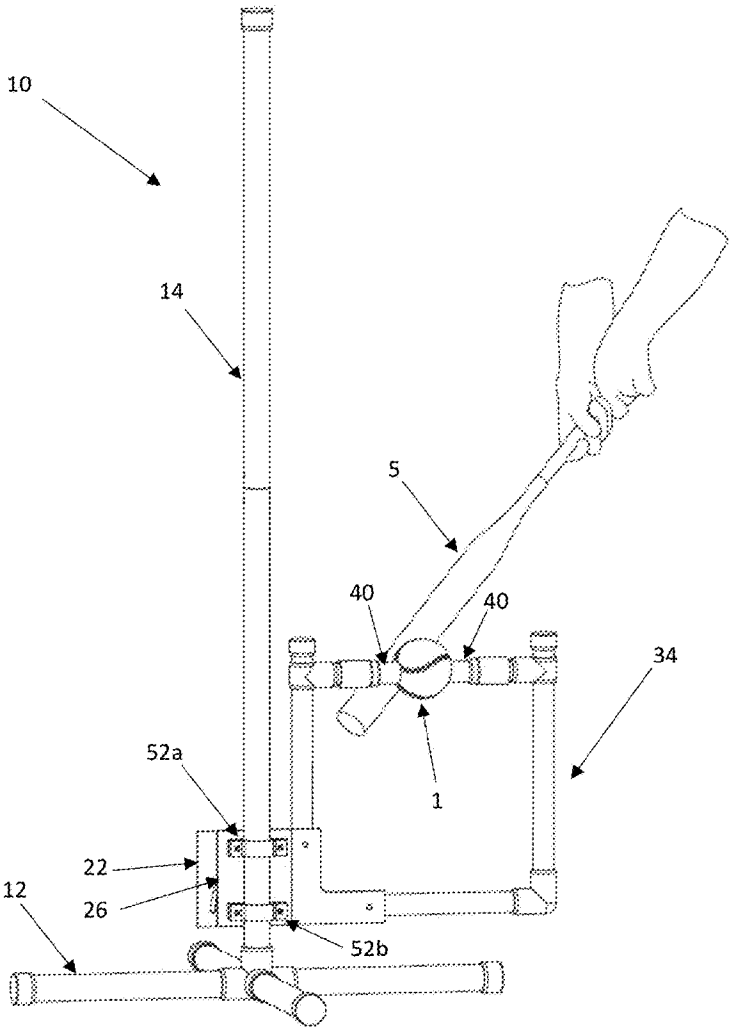
FIG. 6 is a partial, perspective view of the batter swinging at the ball supported by the tee of FIGS. 1-2 in a position differing from that of FIG. 5.
Figure 7:
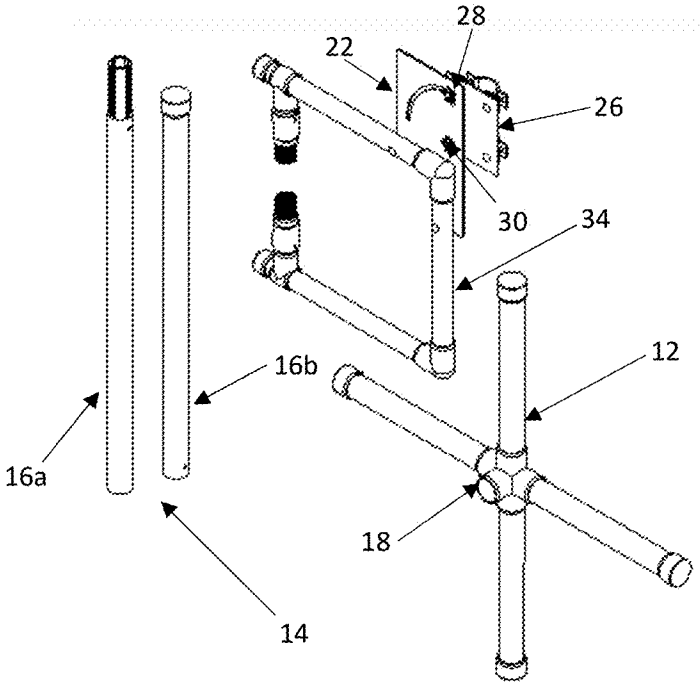
FIG. 7 is a partially exploded or disassembled view of the tee of FIGS. 1-2.
Figure 10:
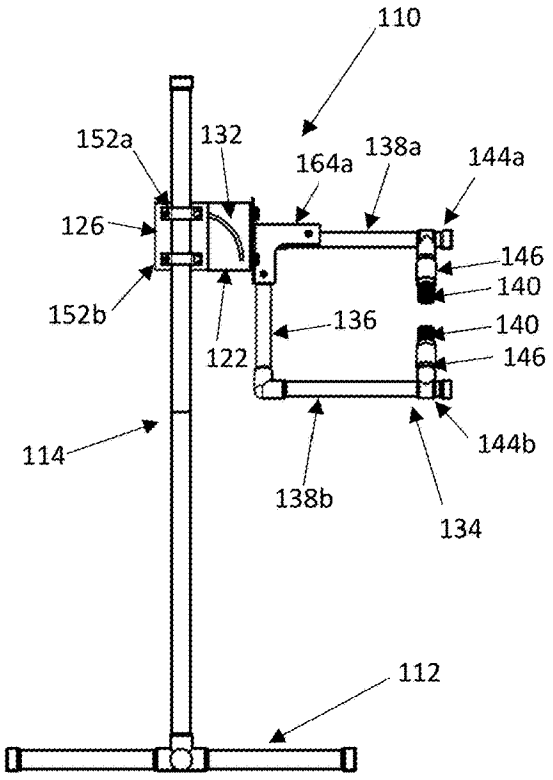
FIG. 10 is a rear view of the tee of FIGS. 8-9.
Figure 9:
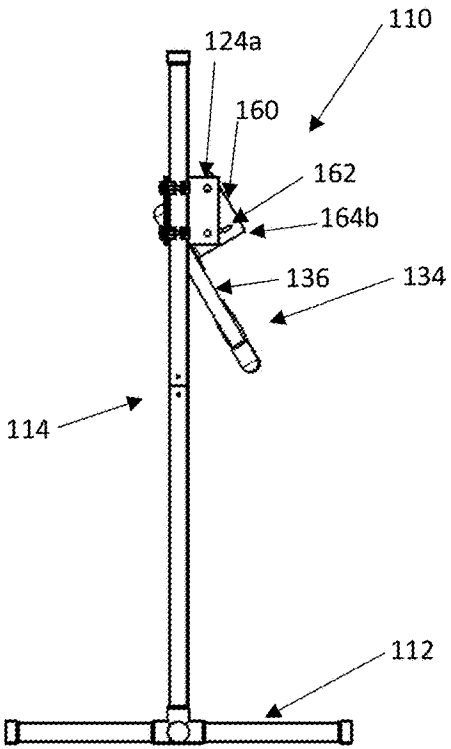
FIG. 9 is a side view of the tee of FIG. 8.

In various embodiments, at least one suspension member 40 is operatively connected to each distal end 44*a*, 44*b* of the extension arms 38*a*, 38*b*. The suspension members 40 allow the ball 1 (e.g., baseball, softball, whiffle ball or the like) to be suspended therebetween as is generally depicted in FIGS. 5-6. Each respective extension arm 38*a*, 38*b* may optionally include a mounting member 46 interconnecting the respective suspension member 40 to the extension arms 38*a*, 38*b*. The mounting members 46 can also optionally be configured to be pivotable and/or telescoping. Optionally, one or both of the suspension members 40 and mounting members 46 are arranged and configured to be adjustable to hold a variety of differently sized balls (e.g., 12" and 11" softballs as well as a 9" baseball). It is envisioned that the disclosures herein can be configured to suspend other balls or objects in a similar fashion to be used as a teaching aid for cricket, volleyball and the like, for example. It is important to note that in the illustrated embodiment, the ball 1 is suspended using suspension members 40 that are brushes but it is to be understood that a ball could be biased or suspended using different mechanisms such as, but not limited to, plungers, flexible materials and the like. In the illustrated embodiment, the suspension members or brushes 40 oppose one-another and provide a space therebetween in which the ball 1 can be positioned and supported. Alternate embodiments can include more than two brushes and, if other suspension members 40 are used, the suspension members 40 could be positioned axially or in parallel or other configurations to suspend the ball 1.

In optional embodiments, the mounting members 46 to which the brushes 40 are attached are biased in position by mechanical springs or the like (not visible) positioned within the mounting members 46. The mounting members 46 are biased so that if the bat 5 or batter contacts the brushes 40 or mounting members 46 while swinging, the contacted mounting members 46 will become dislodged from their vertical position to absorb the energy of the swing and they will be biased by the mechanical springs back to their original position generally perpendicular to the extension arms 38*a*, 38*b* shown in FIGS. 1-2 and 5-6, for example. There are other ways to absorb the contact of the bat 5 and bias the mounting members 46 to a position generally perpendicular to the extension arms 38*a*, 38*b*. Some examples include using flexible materials for the mounting members 46 or biasing the mounting members 46 with a pliable material that has memory (e.g., rubber, plastics, etc.). Although not shown, a ball-and-socket-type arrangement could also be used in alternate embodiments. It should be noted that other members (not shown) could be added in a perpendicular direction to the mounting members 46, extension arms 38*a*, 38*b* or connecting arm 36 to give the batter feedback on the follow through of the individual's swing.

In one illustrative example, FIG. 5 shows the tee 10 oriented to simulate a high outside pitch. In this orientation, the ball 1 is suspended between two longitudinally resilient suspension members 40 (e.g., brushes, springs or the like) operatively connected to respective mounting members 46 that are generally perpendicular to respective extension arms 38*a*, 38*b*. The extension arms 38*a*, 38*b* are separated by a connecting arm 36 that is connected to an apparatus that is slidably connected to the vertical stand or base 12. In this embodiment, the two extension arms 38*a*, 38*b* and the connecting arm 36 generally form a "C" shape. In the middle of the "C", the ball 1 can be suspended for the batter by two suspension members 40 that are positioned generally perpendicular to the two extension arms 38*a*, 38*b*. The suspension members 40 are configured to give way should the bat 5 also contact the suspension members when attempting to hit the ball 1. By suspending the ball 1 in this manner, the ball support assembly 34 can be rotated from 0 degrees to 90 degrees, or any angles in-between, to form a "U" or "C" utilizing the angled slot 32 and angle adjustment assembly 28. When the ball 1 is suspended in the "U" position as is shown in FIG. 6, the tee 10 allows the batter to hit a simulated low inside pitch or a simulated low outside pitch at actual knee level or below. Proper bat angle is not possible with current batting tees. With current batting tees, a "correct" swing will strike the tee's vertical support because the ball sits on top of the tee instead of being suspended. Current tees do not allow the ball to be placed at or below most batter's knee level because of limitations inherent to their design.

Another additional feature of the tee 10 is that the extension arms 38*a*, 38*b* of the ball support assembly 34 define a swing plane that the bat 5 must follow to hit the suspended ball 1 (see, e.g., FIG. 5). It is generally accepted that the main key to a successful swing is for the batter's swing plane and bat 5 to match the trajectory or path of the pitched ball 1 (batter wants to be "long in the path of the ball") to have a high percentage of making contact with the ball 1. By having the ball 1 suspended between the extension arms 38*a*, 38*b*, the batter is required to swing the bat 5 on a swing plane that bisects a plane defined by the extension arms 38*a*, 38*b* and matches the simulated trajectory of the ball 1.

In various embodiments, the tee 10 is configured to have separable components for ease of assembly and transportation. The separable components can be housed in a bag or box (not shown). To assemble the tee 10, the base 12 can be positioned on the ground or other surface and then the lower vertical component 16*a* of the vertical support can be positioned within a base receiver 18 and snapped into place. Next, the upper vertical 16*b* component is connected to the lower vertical component 16*a*. An alternative embodiment could include having flexible straps that link the base receiver 18 to the lower end of the lower vertical component 16*a* and the lower end of the upper vertical component 16*b* to the upper end of the lower vertical component 16*a*, similar to tent posts. Then, the vertical adjuster 30 can be secured over the vertical support 14 and tightened, as discussed above.

A second alternate tee 110 is illustrated in FIGS. 8-20. The tee 110 is largely similar to that of FIGS. 1-7 and only differs in ways explicitly stated. The tee 110 includes a base 112 to which a vertical support 114 is connected via a base receiver 118. Attached to the vertical support 114 is a ball support assembly 134, which is configured to be slidably, pivotably and/or rotatably adjustable to position and support a ball in even more positions than those illustrated in FIGS. 1-7.

Figure 8:
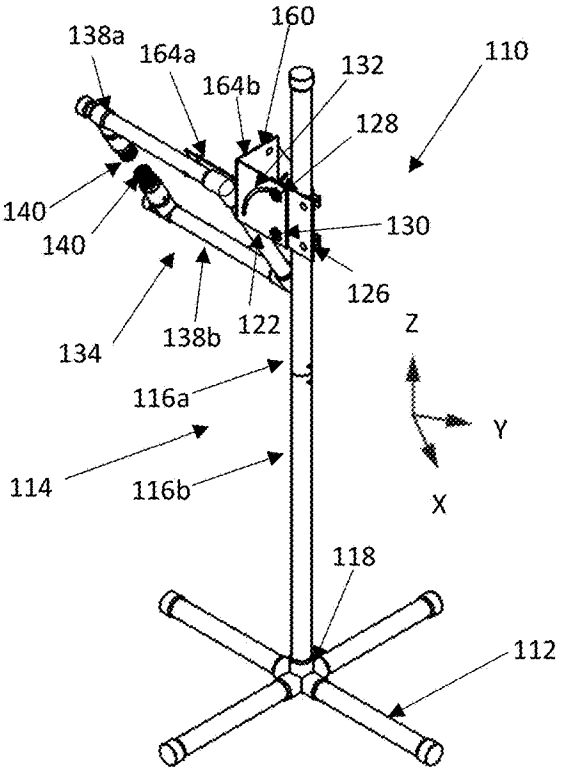
FIG. 8 is a perspective view of an alternate tee having a ball support assembly.

Similar to the previously described embodiment, to provide for adjustment the ball support assembly 134 within the xz-plane as defined in FIG. 8, a bat path adjuster bracket 122 is operatively connected to the vertical support 114. The bat path adjuster bracket 122 includes a first plate 124*a* connected to a second plate 124*b*. The bat path adjuster bracket 122 and the connector plate 126 include respective apertures 146*b*, 172 (see, in particular, FIGS. 11 and 14-15) through which the vertical adjuster 130 extends to contact the vertical support 114. The bat path adjuster bracket 122 includes an arched or angled slot 132 and the connector plate 126 includes an aperture 146*a* (see, in particular, FIGS. 11 and 14-15) through which the angle adjustment assembly 128 extends. The ball support assembly 134 is operatively connected to the ball path adjuster bracket 160 with mechanical fasteners or the like. In one example embodiment, the ball support assembly 134 includes a connecting arm 136 to which the ball path adjuster bracket 160 is secured and has two extension arms 138*a*, 138*b* that extend outwardly from the connecting arm 136 at approximately 90 degrees. In the illustrated example embodiment, to actuate the bat angle adjuster plate 122 within the yz-plane, the angle adjustment assembly 128 is rotated (e.g., via counter-clockwise rotation of a knob) to release maintaining friction on the bat path adjuster plate 122 so that the bat path adjuster bracket 122, ball path adjuster plate 160 and ball support assembly 134 can rotate with respect to the vertical support 114 within the arched slot 132. Once the desired rotational position is obtained, the angle adjustment assembly 128 is rotated in the opposite direction to increase friction between the bat path adjuster bracket 122 and the angle adjustment assembly 128 until there is enough friction to maintain the bat path adjuster bracket 122 in position.

In this embodiment, the tee 110 is further adjustable in that the ball support assembly 134 which is operatively connected to the ball path adjuster bracket 160 can pivot with respect to the vertical support 114 (i.e. yz-plane) and the bat path adjuster bracket 122. The ball path adjuster bracket 160 includes an arched slot 162 within a plate 164 that functions similarly to the bat path adjuster bracket 122 but provides rotational adjustment relative to the yz-plane versus rotating in the yz-plane. The arched slot 162 can be configured to provide for a range of about 0 to about 90 degrees of rotation with respect to the vertical support 114 (i.e. yz plane), for example (which can be useful for volleyball training). To accomplish this adjustability, the bat path adjuster bracket 122 is connected to a ball path adjuster bracket 160. Particularly, in this embodiment, the first plate 124*a* of the bat path adjuster bracket 122 functions similarly to the connector plate 126 for the bat path adjuster bracket 122. One fastener 174 is secured within apertures 166 and 170*a* and a second fastener, an angle adjustment assembly 176, which is similar to the angle adjustment assembly 28, is secured within an angled or arched slot 162 and second aperture 170*b*. As with the bat path adjuster bracket 122, actuation of the adjustment can be accomplished with an angle adjustment assembly 176 that is generally the same as angle adjustment assembly 128, discussed above. Detailed views of the ball path adjuster bracket 160 and the bat path adjuster bracket 122 are shown in FIGS. 12-13 and 14-15, respectively. Both arched slots 132 and 162 can independently be adjusted to position the ball support assembly 134, as desired.

As with the prior disclosed embodiment, the vertical adjuster 130 allows the bat path adjuster bracket 122 to be positioned at desired locations along a length (i.e. height) of the vertical support 114 (i.e. the z-axis). The vertical position of the ball support assembly 134 can be adjusted along a length of the vertical support 114 using one or more collars 152*a*, 152*b* that mate with the vertical support 114. The collars 152*a*, 152*b* can be configured identically to collars 52*a*, 52*b* disclosed with respect to FIG. 3 or alternative mechanisms can be utilized.

As with the prior disclosed embodiment, rotational adjustment of the ball support assembly 134 within the xy-plane about the vertical support 114 (i.e. z-axis) can be accomplished similar to that of the prior embodiment by rotating the loosened collars 152*a*, 152*b* around the vertical support 114 to a desired position before re-tightening the collar 152*b*. In this way, the ball support assembly 134 can be positioned at an angle α, ranging from about 0 to about 360 degrees with respect to the base 112 or xy-plane (see, in particular, FIG. 4).

The ball support assembly 134 can include optional mounting members 146 interconnecting the extension arms 138*a* 138*b* to respective suspension members 140. The mounting members 146, in combination with the suspension members 140, allow a user to hit the ball while the ball support assembly 134 is in a "C" oriented position or "U" oriented position and different positions in-between as discussed above with respect to prior embodiments.

In various embodiments, at least one suspension member 140 is operatively connected to each distal end 144*a*, 144*b* of the extension arms 138*a*, 138*b*. The suspension members 140 allow a ball to be suspended therebetween. Each respective extension arm 138*a*, 138*b* may optionally include a mounting member 146 interconnecting the respective suspension member 140 to the extension arms 138*a*, 138*b*. The mounting members 146 can also optionally be configured to be pivotable and/or telescoping.

The disclosed tees 10, 110 provide for batter training in all aspects of the swing from point of contact, bat angle, extension and follow through with the ability to work on these fundamental swing components in all parts of a batter's strike zone. The configuration and placement of the ball support assembly 34, 134 requires the batter to bisect the two planes created by the extension arms 38*a*, 38*b*, 138*a*, 138*b* with the bat 5 in order to make contact with the suspended ball 1 (i.e. to effectively hit the suspended ball 1). Moreover, the ball support assembly 34, 134 can be positioned at all levels and locations of the strike zone. In other words, the disclosed embodiments are multidimensional in that they allow for proper bat angles and points of contact on high, low and inside or outside parts of the strike zone. The configuration of the ball support assembly 34, 134 requires the batter to swing the bat 5 on a plane that aligns with the simulated trajectory/path of the ball 1 and to keep their hands inside and not "cast" them during their swing, which is a common hitting flaw where the hitter moves their hands outwardly and away from their body while swinging. The connecting arm 36, 136 of the ball support assembly 34, 134 creates a physical blocker that helps prevents such "casting."

Embodiments described and shown herein can be constructed of tubular, round plastic (PVC) components, for example. Other lightweight, durable material could be used (e.g., polycarbonate, aluminum, etc.) and other material shapes could be used (e.g., square, rectangular, solid, etc.). In various embodiments, the extension arms 38*a*, 38*b*, 138*a*, 138*b* and/or connecting arm 36, 136 can be padded to prevent accidental damage to a bat or the tee 10, 110 during use. The scope of the disclosure is not intended to be limited to any specific materials.

Although example embodiments have been described for use in baseball or softball batting practice, it is recognized that modifications could be made to the tee so that the tee could be used for other types of sports such as, but not limited to, volleyball, tennis, racket ball, cricket, and the like.

The above specification, examples, and data provide a complete description of the manufacture and use of the composition of embodiments of the invention. Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the invention. Therefore, it is manifestly intended that this invention be limited only by the claims and the equivalents thereof.

What is claimed is:

1. A tee for supporting a ball, the tee comprising:

a base defining an x-axis;

a vertical support extending from the base; the vertical support defining a z-axis; and a ball support assembly adjustably secured to the vertical support; the ball support assembly defining a y-axis, the ball support assembly arranged and configured to releasably support a ball and release the ball upon contact during use;

a bat path adjuster bracket connected to the ball support assembly; wherein the bat path adjuster bracket is operatively connected to the vertical support with a connector plate, the bat path adjuster bracket including a first aperture and a first arched slot, a vertical adjuster extends through the first aperture to interconnect the bat path adjuster bracket and the connector plate, a first angle adjuster extends through the first arched slot to interconnect the bat path adjuster bracket and the connector plate, the vertical adjuster allowing selective vertical adjustment along the vertical support, the first angle adjuster allowing selective rotation of the bat path adjuster bracket with respect to the connector plate within the first arched slot;

wherein the x-axis and the y-axis define an xy-plane, the x-axis and the z-axis define a xz-plane, the y-axis and the z-axis define a yz-plane;

wherein the ball support assembly is adjustable along the z-axis by moving relative to the vertical support and adjustable 0 to 90 degrees within at least one plane selected from the group consisting of the xz-plane and the yz-plane.

2. The tee of claim 1, wherein the ball support assembly includes a first extension arm and a second extension arm interconnected by a connecting arm, the first and second extension arms arranged and configured to releasably support the ball therebetween.

3. The tee of claim 2, wherein the ball support assembly includes a first suspension member extending from the first extension arm and a second suspension member extending from the second extension arm, the first and second suspension members being arranged and configured to contact opposing sides of the ball and releasably support the ball therebetween.

4. The tee of claim 2, further comprising a first mounting member interconnecting the first suspension member and the first extension arm and a second mounting member interconnecting the second suspension member and the second extension arm.

5. The tee of claim 2, wherein the first suspension member and the second suspension member are resilient.

6. The tee of claim 2, wherein the first suspension member and the second suspension member are selected from the group consisting of a brush and a plunger.

7. The tee of claim 2, wherein the first extension arm and the second extension arm that are parallel to one another.

8. The tee of claim 1, wherein the ball support assembly can be rotated from about 0 degrees to about 360 degrees within the xy-plane.

9. The tee of claim 1, further comprising an adjustment member having a plate portion to which a connector is operatively connected with a vertical adjuster for adjustment along the z-axis and an angle adjuster for adjustment within the yz-plane.

10. The tee of claim 9, wherein the plate portion and the connector include respective apertures through which the vertical adjuster extends to contact the vertical support.

11. The tee of claim 9, wherein the plate portion includes an arched slot and the connector includes an aperture through which the angle adjuster extends.

12. The tee of claim 1, wherein the ball support assembly can be positioned along substantially an entire length of the vertical support.

13. The tee of claim 1, wherein the ball support assembly is arranged and configured to be adjustable within at least two planes selected from the group consisting of the xy-plane, the xz-plane and the yz-plane.

14. The tee of claim 13, wherein the ball support assembly is arranged and configured to be adjustable within the xy-plane, the xz-plane and the yz-plane.

15. The tee of claim 1, wherein the ball support assembly includes at least one suspension member.

16. The tee of claim 1, further comprising:

an adjustment member having a plate portion to which a connector is operatively connected with a vertical adjuster and an angle adjuster;

wherein the ball support assembly includes two extension arms interconnected by a connecting arm; and one suspension member for releasably supporting the ball.

17. The tee of claim 1, further comprising a ball path adjuster bracket operatively connected to the bat path adjuster bracket, the ball path adjuster bracket including a second aperture and a second arched slot, a fastener extends through the second aperture to interconnect the ball path adjuster bracket and the bat path adjuster bracket, a second angle adjuster extends through the second arched slot to interconnect the ball path adjuster bracket and the bat path adjuster bracket, the second angle adjuster allowing selective rotation of the ball path adjuster bracket with respect to the bat path adjuster bracket within the second arched slot.

18. A tee for supporting a ball, the tee comprising:

a base;

a vertical support extending from the base;

a ball support assembly adjustably secured to the vertical support and including a first extension arm and a second extension arm, a first suspension member operatively connected to the first extension arm, and a second suspension member operatively connected to the second extension arm, the first and second suspension members being arranged and configured to contact opposing sides of the ball and releasably support the ball therebetween;

a bat path adjuster bracket operatively connected to the ball support assembly and operatively connected to the vertical support with a connector plate, the bat path adjuster bracket including an aperture and an arched slot, a vertical adjuster extends through the aperture to interconnect the bat path adjuster bracket and the connector plate, an angle adjuster extends through the arched slot to interconnect the bat path adjuster bracket and the connector plate, the vertical adjuster allowing selective vertical adjustment along the vertical support, the angle adjuster allowing selective rotation of the bat path adjuster bracket with respect to the connector plate within the arched slot.

19. The tee of claim 1, further comprising an adjustment member having a plate portion operatively connected to the vertical support, the plate portion including a slot configured and arranged to adjust the ball support assembly 0 to 90 degrees within the at least one plane.

20. The tee of claim 18, further comprising a ball path adjuster bracket operatively connected to the bat path adjuster bracket, the ball path adjuster bracket including a second aperture and a second arched slot, a fastener extends through the second aperture to interconnect the ball path adjuster bracket and the bat path adjuster bracket, a second angle adjuster extends through the second arched slot to interconnect the ball path adjuster bracket and the bat path adjuster bracket, the second angle adjuster allowing selective rotation of the ball path adjuster bracket with respect to the bat path adjuster bracket within the second arched slot.

21. The tee of claim 18, wherein the base defines an x-axis, the vertical support defines a z-axis, and the ball support assembly defines a y-axis, and wherein the x-axis and the y-axis define an xy-plane, the x-axis and the z-axis define a xz-plane, the y-axis and the z-axis define a yz-plane, wherein the ball support assembly is adjustable along the z-axis and within at least one plane selected from the group consisting of the xy-plane, the xz-plane and the yz-plane.

22. The tee of claim 18, wherein the first suspension member and the second suspension member are selected from the group consisting of a brush and a plunger.

23. The tee of claim 18, further comprising a connecting arm interconnecting the first and second extension arms, wherein the first and second extension arms are parallel to one another.

* * * * *